United States Patent [19]

Huang

[11] Patent Number: 4,951,396

[45] Date of Patent: Aug. 28, 1990

[54] BASIC FORMULA OF AN ACTIVE LAYOUT DRAWING IN SKIRTS TAILORING

[76] Inventor: Ding S. Huang, 5th Floor, No. 9-16, Lane 344, Nanking W. Rd., Taipei, Taiwan

[21] Appl. No.: 198,174

[22] Filed: May 24, 1988

[51] Int. Cl.[5] ..... A41H 3/00

[52] U.S. Cl. ..... 33/17 R; 33/12; 33/14

[58] Field of Search ..... 33/17 R, 17 A, 9 R, 33/9 A, 10, 12, 15, 11, 2 R, 16

[56] References Cited

U.S. PATENT DOCUMENTS

| | | | |
|---|---|---|---|
| 813,415 | 2/1906 | Geraci | 33/2 R |
| 1,045,449 | 11/1912 | Sobotker et al. | 33/15 |
| 1,114,658 | 10/1914 | Watters | 33/16 |
| 3,177,867 | 4/1965 | Hart | 33/12 |
| 3,883,955 | 5/1975 | Bush | 33/12 |
| 3,979,831 | 9/1976 | Lutz | 33/17 R |
| 4,031,626 | 6/1977 | Dyal | 33/17 R |
| 4,205,446 | 6/1980 | Gibson | 33/17 A |

FOREIGN PATENT DOCUMENTS

| | | | |
|---|---|---|---|
| 1176604 | 1/1970 | United Kingdom | 33/17 R |

OTHER PUBLICATIONS

"Pattern Alteration" by Margaret Smith, pp. 2–5, 10, 34–38, published Apr. 1945 in Washington, DC in Farmer's Bulletin, No. 1968.

*Primary Examiner*—William A. Cuchlinski, Jr.
*Assistant Examiner*—Christopher W. Fulton
*Attorney, Agent, or Firm*—Bucknam and Archer

[57] ABSTRACT

A method of drawing a pattern for custom-tailored skirts in terms of taking into account a person's bodily dimensions, including measures around the waistline, around the largest part of the abdomen, another part of the abdomen thereabove, around the lower and lowermost hip, around the upper hip, various lateral distances between selected of the foregoing measures, the selected length of the skirt, and deviations from a standard body figure in terms of lateral deviations of portions of the wearer's body from a straight vertical line making contact with a laterally most protruding part of the wearer's body.

5 Claims, 6 Drawing Sheets

BASIC FORMULA OF AN ACTIVE LAYOUT DRAWING IN SKIRTS TAILORING

BACKGROUND OF THE INVENTION

The present invention relates to a basic formula of an active layout drawing in skirts tailoring and more particularly a basic formula to measure the figure of human body for making an active layout to fit the differences in body figure.

Regular layout drawing in skirts tailoring is unvarying and can not discover the defect in body figure for compensation in advance, thereby a misfit happens quite often and further alteration is usually required. Therefore, regular layout drawing technique is not perfectly applicable in mass production.

SUMMARY OF THE INVENTION

The main object of the present invention is to provide a right technique in body figure measurement and a basic formula of an active layout drawing in skirts tailoring so as to promote the quality, reduce the loss, and increase the productivity and the profit.

Another object of the present invention is to provide an active layout drawing technique such that the dress maker can easily handle any variation in body figure while tailoring to prevent any further alteration.

DETAILED DESCRIPTION OF THE PREFERRED EMBODIMENT

Figure 1:
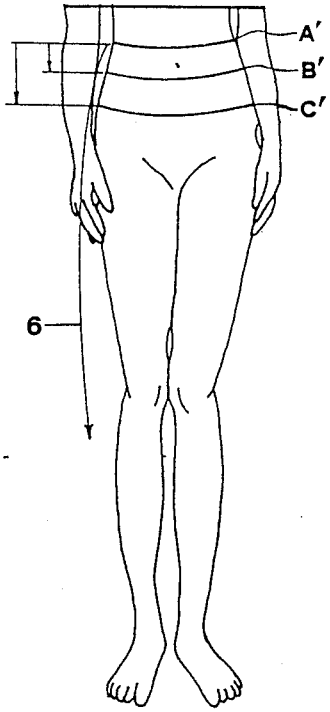
FIGS. 1–2 show the measuring technique applied according to the present invention.
Figure 2:
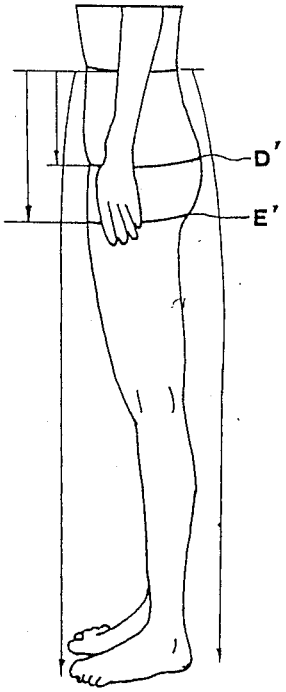

Please refer to FIG. 1 and FIG. 2 regarding the measuring technique applied according to the present invention.

Measure around the waist line (A') (FIG. 1): To measure at the front one circle around the waist line.

Measure around a first lower waist line B' (2): To measure one circle around the abdomen 5 cm below the waist line.

Measure around a second lower waist line C' (3): To measure one circle around the abdomen 10 cm below the waist line.

Measure around the largest part of the hip D' (4): To measure one circle around the hip at the largest part. Then, measure the depth from the waist line to the hip 1.

Measure around the bottom of the hip E' (5): To measure one circle around the hip at the bottom of the hip. Then, measure the depth from the waist line to the hip E'.

Measure of the length of the skirt: To measure laterally from the waist line to a preferred length.

Figure 3:
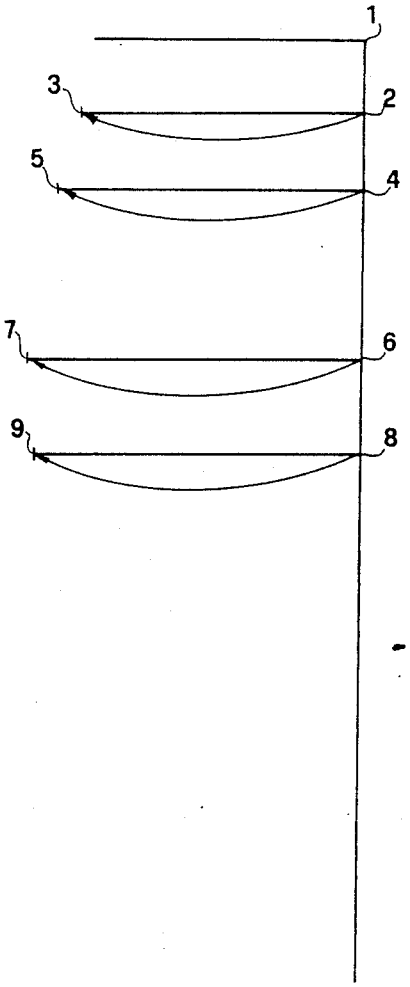
FIGS. 3–6 show the drawing process of the layout drawing technique according to the present invention.
Figure 4:
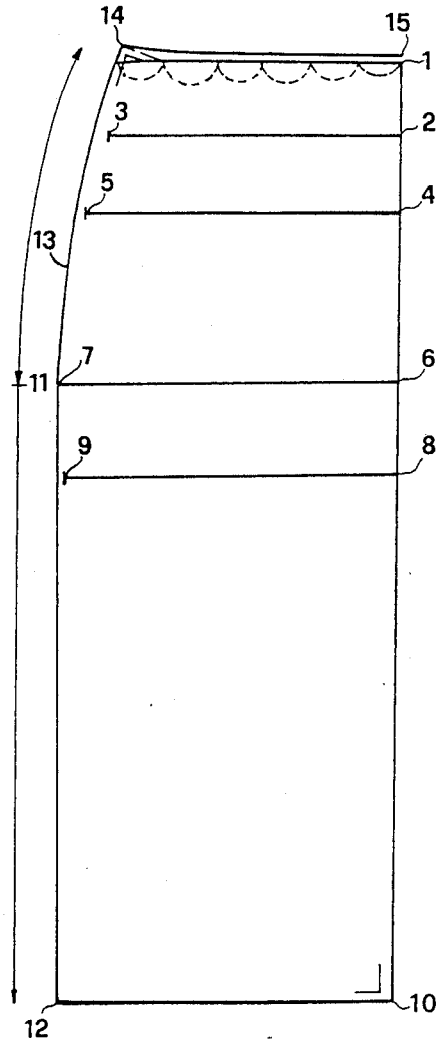
Figure 5:
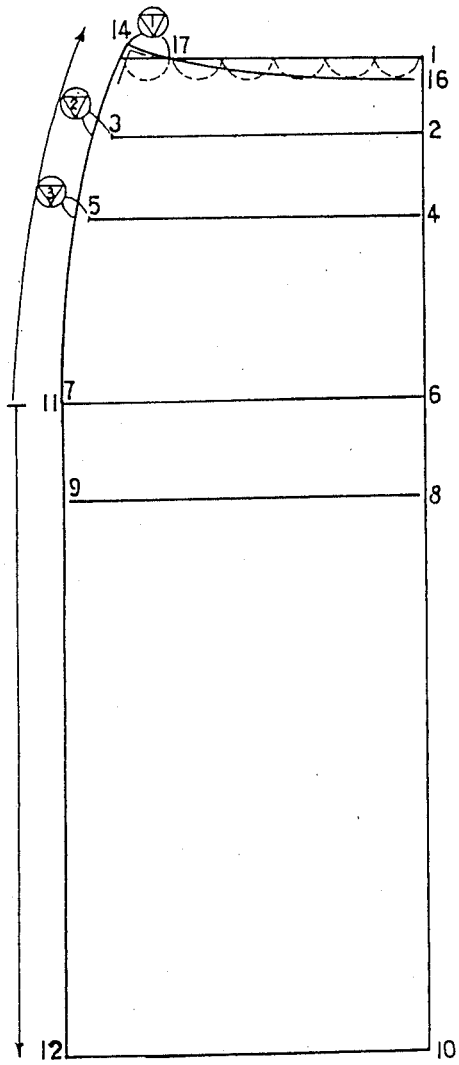
Figure 6:
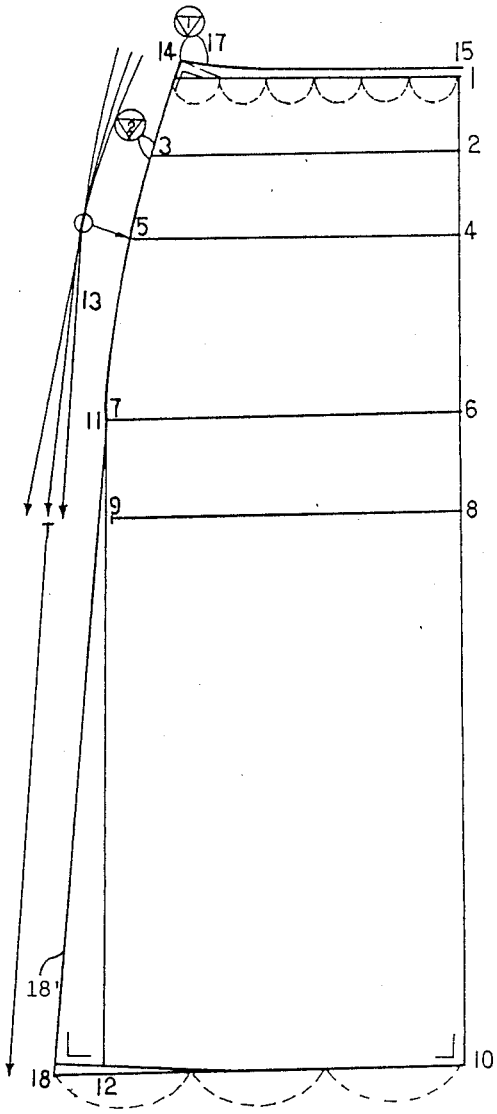
Figure 7:
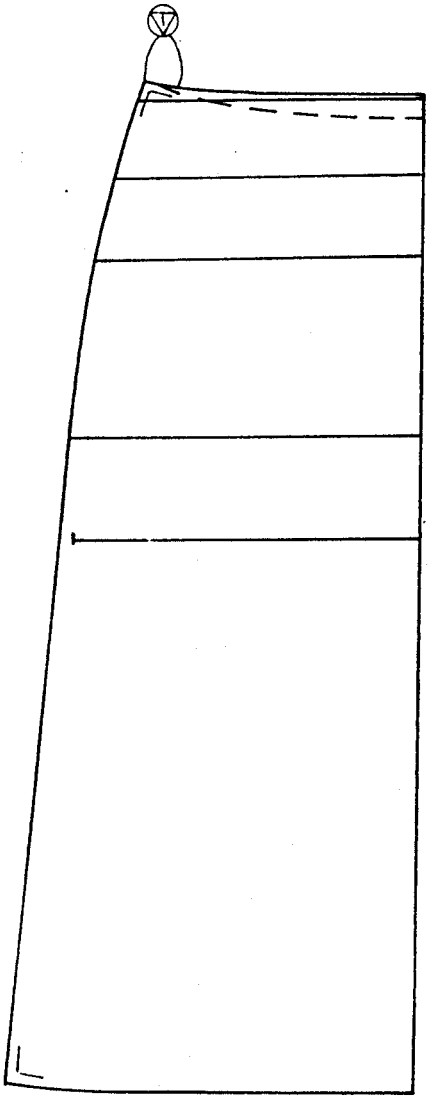
FIGS. 7–8 show a basic model of skirts layout drawing obtained according to the present invention.
Figure 8:
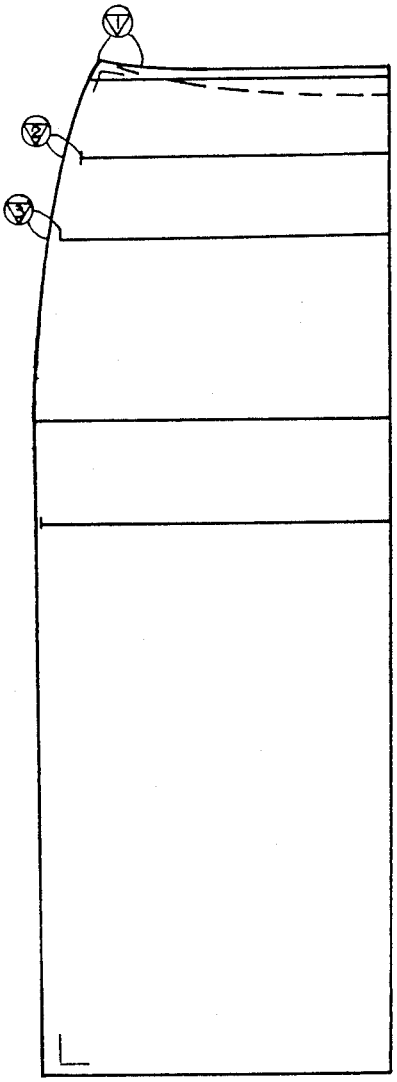
Figure 9:
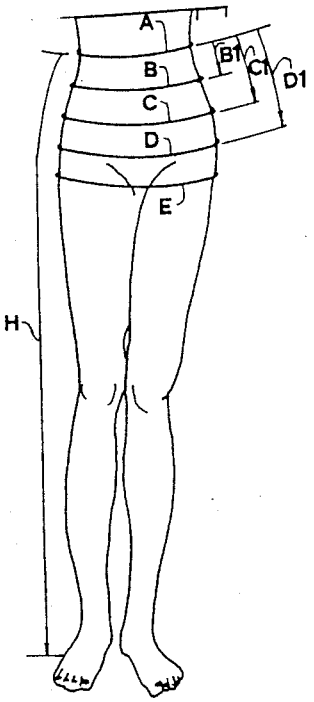
FIGS. 9–14 show the practical measure according to the present invention.
Figure 10:
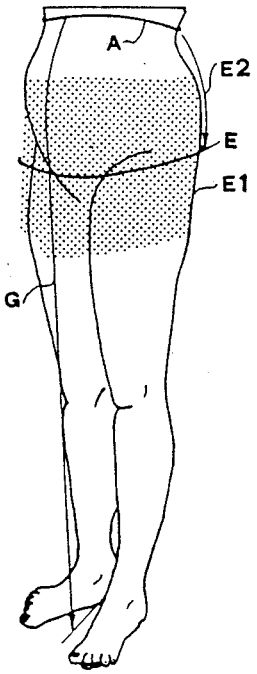
Figure 11:
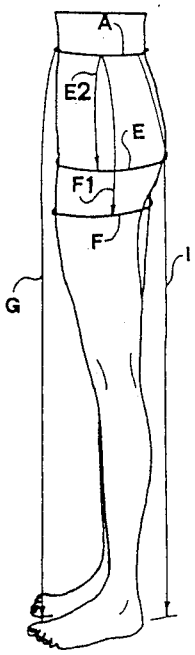
Figure 12:
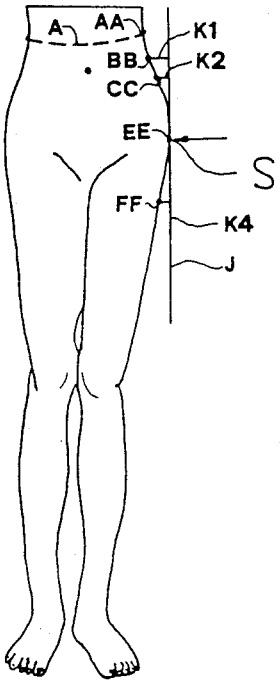

The layout drawing technique is performed, as shown in FIG. 3, in accordance with the data obtained, in a way as described hereinafter:

Select a free point (1) and draw a horizontal line leftward from the point (1) and a vertical line downward from the point (1); set a point (2) at 5 cm downward along the vertical line from the point (1) and draw a horizontal line leftward from the point (2) in a length equal ¼ of the measure around the first lower waist line B' (2) (slack maybe considered according to requirement) so as to obtain a point (3); set a point (4) about 10 cm i.e., as obtained from the measure of the depth from the waist line 1 (A') to the largest part of the hip D' downward along the vertical line from point (1) and draw a horizontal line leftward from the point (4) in a length equal to ¼ of the measure around the second lower waist line C' (slack maybe considered according to requirement) so as to obtain a point (5); set a point (6) downward along the vertical line from the point (1) at a distance of about 22 cm as obtained from the measure of the depth from the waist line to the bottom largest part of the hip D', and draw a horizontal line leftward from the point (6) in a length equal to ¼ of the largest part of the measure around the hip D' (slack maybe considered) so as to obtain a point (7); set a point (8) downward along the vertical line from the point (1) at approximate 28 cm as obtained from the measure of the depth from the waist line to the bottom of the hip, and draw a horizontal line leftward from the point (8) in a length equal to ¼ of the measure around the hip E' (slack maybe considered) so as to obtain a point (9); for the following description, please refer to FIG. 4, set a point (10) downward along the vertical line from the point (1) at a distance equal to the length of the skirt and draw therefrom a horizontal expansion line leftward as for expansion of the skirt, and set a point (11) at the same position as the point (7) and then draw a vertical line downward to cross with the leftwardly extending expansion line of the point (10) at a point (12); draw a curved line (13) properly from the point (11) upward to cross with the horizontal line extending from the point (1); set a point (14) at 1/6 of the width of the layout (spacing between points (6) and (7) above an intersection of the curved line (13) with the horizontal line extending leftwardly from the point (1): draw another horizontal line above the line originating from the point (1) to a position (which would normally correspond to a line around the abdomen) so as to obtain a point (15) (0–0.8 cm above point (1)) (if the measure around the waist line is 66 cm, the measure around the lower waist line 2 is 81 cm, then rise the line 0.5 cm up, and rise up further 0.3 cm if the respective measures are 5 cm over; in case of smaller measures, the line remains unchanged); for the following description, please refer to FIG. 5, set a point (16) at 1.3 cm downward along the vertical line from the point (1); set a point (17) leftward along the horizontal line from the point (1) at a distance equal to ¼ of the measure around the waist line to offer a size for waist line, then draw lines to connect all the peripheral points obtained to form a basic layout model as shown in FIG. 8 wherein the marked area is the folding part; for the following description, please refer to FIG. 6, use a curve to draw a curved line from the point (5) through the point (7) or the point (9) to the bottom point (18) lying on the expansion line of the skirt to form an inclined or side line (18'), then use a triangle with the longest side aimed at the side line [point(11) to point (18)] and with the shortest side passing through one third of the width of the expansion (line joining points 10 and 18) to draw a cutting line so as to complete the basic layout model as shown in FIG. 7.

Please refer to the practical measure as shown in FIGS. 9–14. In the present preferred embodiment, the features of the present practical measure are described hereinafter:

Measure around the waist line (A): Use a belt of width of 3 cm to fasten up the waist and then use a measuring tape to measure one circle around the waist. (72 cm in the embodiment).

Measure around the abdomen 2 (C): Measure one circle around the largest part of the abdomen below the waist line (A) (92 cm in the embodiment). Then measure the depth laterally from the waist line (A) to the abdomen (C), the size thus obtained is the depth 2 (C1) (10 cm in the embodiment).

Measure around the abdomen 1 (B): Measure one circle around the abdomen between (A) and (C) (84 cm in the embodiment). Then measure the depth laterally from the waist line (A) to the abdomen (B), the size thus obtained is the depth (B1) (5 cm in the embodiment).

Measure around the lower hip 2 (E): Measure one circle around the hip at the largest part (96 cm in the embodiment). Then measure the depth laterally from the waist line (A) to the hip line (E), the size thus obtained is the depth 4 (E2) (23 cm in the embodiment).

Measure around the upper hip 1 (D): Measure one circle around the hip between the abdomen 2 (C) and the hip line 2 (E) (95 cm in the embodiment). Then measure the depth from the waist line (A) to the upper hip line (D), the size thus obtained is the depth 3 (D1).

Measure around lowermost hip 3 (F): Measure one circle around the the legs at the bottom of the crotch (94 cm in the embodiment). Then measure the depth from the waist line (A) to the lowermost hip line (F), the size thus obtained is the depth 5 (F1) (29 cm in the embodiment).

Measure of the side length (H): Measure laterally from the waist line to the horizontal of the ground (99 cm in the embodiment).

Measure of the front length (G): Measure at the front from the waist line to the horizontal of the ground (98 cm in the embodiment).

Measure of the back length (I): Measure at the back from the waist line through any horizontally protruding part of the hip to the horizontal of the ground (97 cm in the embodiment).

Measure of the side curve: Designate a side point (AA) for the waist line (A), a side point (BB) for the top abdomen 1 (B), a side point (CC) for the bottom abdomen 2 (C), a side point (EE) for the hip 2 (E), a side point (FF) for the hip 3 (F), then measure the side curve at each designated point by a meter. Or, alternately, position a straight line or ruler (J) vertically so as to be tangent to a rightmost protruding part of the body, as shown in the FIGS. 12–14 i.e. (S) (M) (L) resp. covering the area between the waist line (A) and the hip line 3 (F), then measure the width from the ruler (J) to the side point (BB) as for the side curve (K1); the width from the ruler (J) to the side point (CC) as for the side curve (K2); the width from the ruler (J) to the side point (EE) as for the side curve (K3); the width from the ruler (J) to the side point (FF) as for the side curve (K4).

Figure 17:
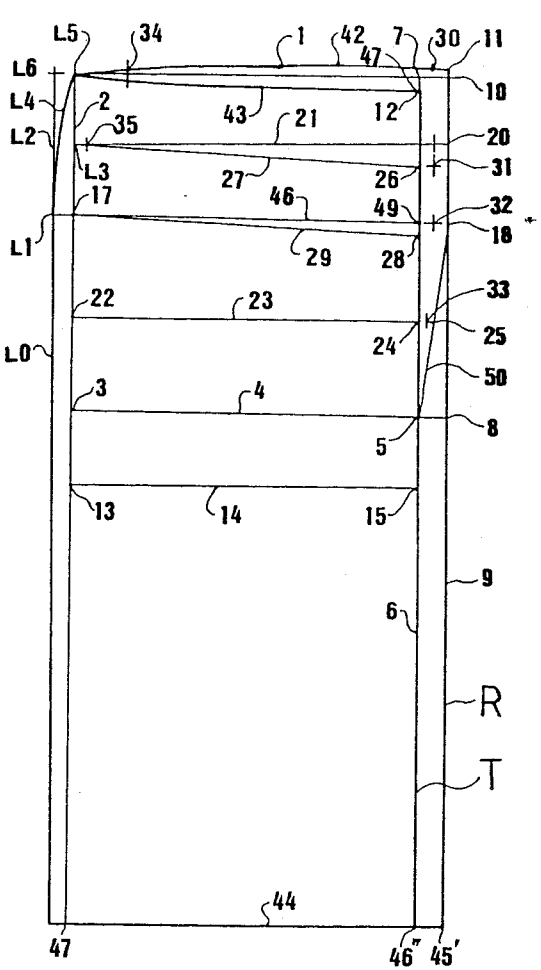
FIGS. 15–17 show different basic models of the layout drawing according to the present invention.
Figure 16:
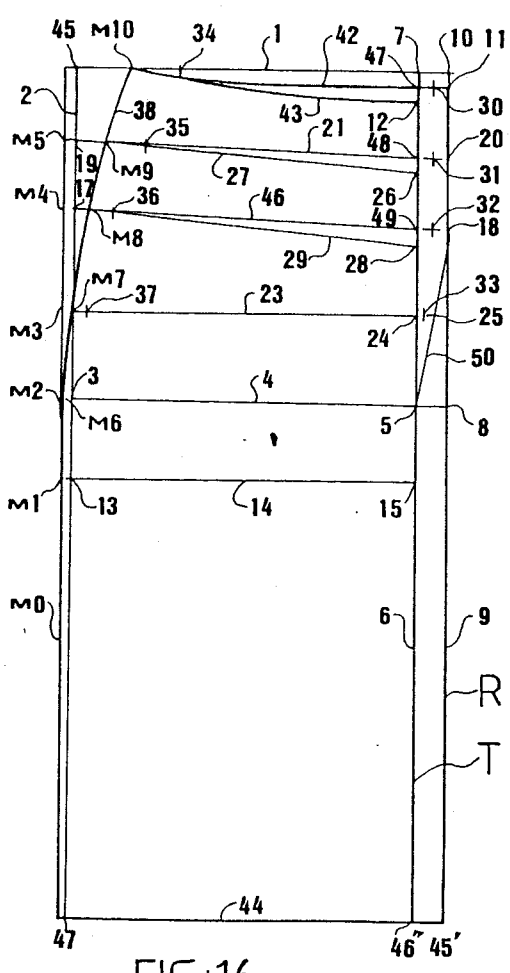
Figure 15:
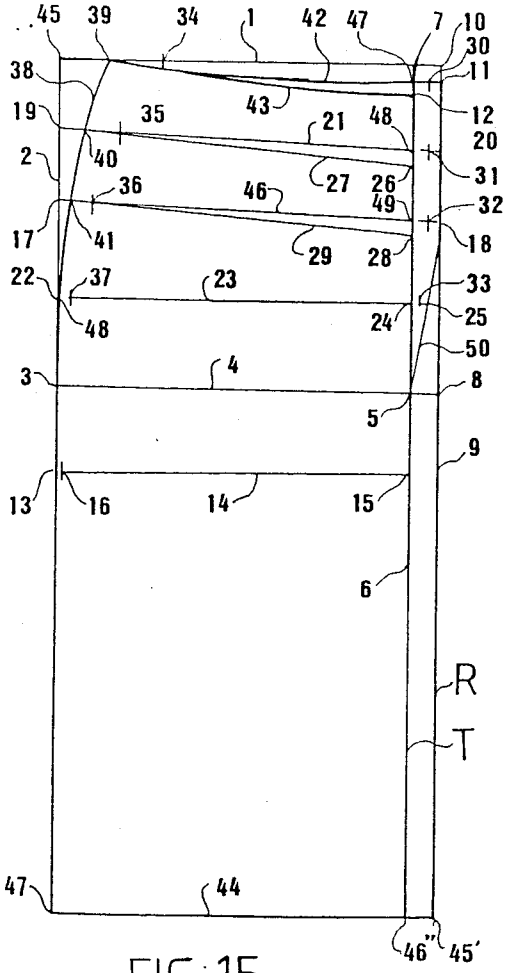

Please refer to the FIGS. 15–17 for the drawing of the basic layout models according to the data obtained. The layout drawing of the front piece (T) and the back piece (R) as shown in FIG. 15 is completed in a way to freely draw a horizontal line (1) in a length ¼ more over the measure (E) and draw a vertical line (2) downward from left end of the horizontal line (1), and then set a point (3) along the vertical line (2) from the point (1) at a distance equal to the depth (E2) (23 cm), then draw a horizontal line (4) rightward from the point (3), then set a point (5) rightward along the horizontal line (4) from the point (3) at a distance equal to ¼ of the measure (E) (¼ of 96 cm=24 cm); draw a vertical line through the point (5) as a central line for the back piece (R) upward to a cross point (7) at the horizontal line (1) and downward to a horizontal line (44) at a selected depth of the expansion of the skirt; set a point (8) rightward along a horizontal line from the point (5) at a distance equal to ½ of the difference between the measure (E) and the measure (E1) [½ of (100 cm−96 cm)=2 cm], to obtain a point (8), then draw therefrom a vertical line (9) as a central line for the front piece (T) upward to a cross point (10) at the horizontal line (1) and downward to the bottom of the expansion line (44) of the skirt; compare the front length (G) (98 cm) and the side length (H) (99 cm), if the size (G) is shorter than the size (H) (1 cm shorter), use the difference in size to set point (11) downward from the point (10) along the vertical line (9) and then draw therefrom a horizontal line (42) to cross with the vertical line (6) at a cross point (47), if the size (G) is larger than the size (H) (0.5 cm for example), use the difference in size to set the point (11) upward from the point (10) along the vertical line (9) as the top point of the central line of the front piece (T) and then draw a slightly downwardly curved line (42) to connect the points (11) and (39); although this is not shown in FIG. 15, it corresponds to the line (42) connected between points (7) and (L5) in FIG. 17; compare the back length (I) (97 cm) and the side length (H) (99 cm), if the size (I) is shorter than the size (H) (2 cm shorter), use difference in size to set a point (12) downward along the vertical line (6) from the point (7) as the top point of the central line of the back piece (R). The case where size (I) is greater than size (H) is not considered here; set a point (13) downward along the vertical line (2) from leftmost point (45) on line 1, which point (13) is at a distance equal to the depth (F1) (29 cm), then draw a horizontal line (14) rightward from the point (13) to cross with the central line (6) of the back piece at a cross point (15); set a point (16) leftward along the horizontal line (14) from the point (15) at a distance equal to ¼ of the measure (F) (¼ of 94 cm=23.5 cm); set a point (17) downward along the vertical line (2) from the point (45) at a distance equal to the depth 2 (C1) (10 cm), and then set a point (18) downward along the vertical line (9) from the point (11) at a distance equal to the depth 2 (C1), and then draw an oblique line (46) to connect points (17) and (18) and to cross with the vertical line (6) at a cross point (49), and then draw another oblique line (50) to connect points (5) and (18); set a point (19) downward along the vertical line (2) from the point (45) at a distance equal to the depth 1 (B1) (5 cm) and set a point (20) downward along the vertical line (9) from the point (11) at a distance equal to the depth 1 (B1), then draw an oblique line (21) to connect points (19) and (20) and to cross with the vertical line (6) at a cross point (48); set a point (22) downward along the vertical line (2) from the point (45) at a distance equal to the depth 3 (D1) (17 cm), then draw a horizontal line (23) rightward from the point (22) to cross with the vertical line (6) at a cross point (24) and to cross with the oblique line (50) at a cross point (25); set a point (26) downward along the vertical line (6) from the point (12) at a distance equal to the depth 1 (B1) (5 cm), then draw an oblique line (27) to connect points (19) and (26); set a point (28) downward along the vertical line (6) from the point (12) at a distance equal to the depth 2 (C1) (10 cm), then draw an oblique line (29) to connect points (17) and (28); set a central point (30) between the point (11) and the point (47) of the central line (9) and the central line (6), a central point (31) between the point (20) and the point (48), a central point (32) between the point (18) and the point (49), and a central point (33) between the point (25) and the point (24); set a point (34) leftwardly from the point (30) along horizontal line 1 at a distance equal to ¼ of the measure (A) (¼ of 72 cm=18 cm); set a point (35) leftward along the horizontal line (21) from the point (31) at a distance equal to ¼ of the measure (B) (¼ of 84 cm=21 cm); set a point (36) leftward along the horizontal line (46) from the point (32) at a distance equal to ¼ of the measure (C); set a point (37) leftward along the horizontal line (23) from the point (33) at a distance equal to ¼ of the measure (D) (¼ of 95 cm=23.75 cm); set a point (41) rightward along the horizontal line (46) from the point (17) at a distance equal to ½ of the size (K2) (½ of 0.8 cm=0.4 cm), then set a point (40) rightward along the horizontal line (21) from the the point (19) at a distance equal to ½ of the measure (K1) (½ of 2.4 cm=1.2 cm), and then draw a curved line (38) upward from the point (13) through points (41) and (40) to cross with the horizontal line (1) at a cross point (39); draw a straight horizontal line from the point (11) leftward to a distance of one third of the length between the point (11) and the point (39) and then continue the line in a curved shape up to the point (39) to form a complete waist line (42) for the front piece; draw another waist line (43) for the back piece in a similar manner from the point (12) to the point (39); set the horizontal line (44) for the expansion of the skirt downward from the horizontal line (1) at a selected distance for the length of the skirt (60 cm in the embodiment) to respectively cross with the vertical lines (2), (6), (9) at the cross points (47), (46), (45'); draw the outline of the front piece from the point (11) downward along the vertical line (9) to the cross point (45'), then turning leftward along the horizontal line (44) to the point (47) and then turning upward to the point (3), and therefrom along the side curved line (38) through points (41) and (40) up to the point (39) and then turning rightward along the curved line (42) to the original point (11); make respective marks at horizontal lines (21), (46), (23), (4) and (14) and the oblique line from point (18) to point (5) and the points (34), (35), (36), (37) and (16); draw the outline for the back piece from the point (12) along the vertical line (6) to the point (46) then turning leftward along the horizontal line (44) to the point (47) and then turning upward to the point (3) and then along the curved line (38) through points (48), (41) and (40) to the point (39) and then turning rightward along the waist line (43) up to the original point (12); make respective marks at the oblique lines (27), (29), (23), (4) and (14) and the points (34), (35), (36), (37) and (16); the area between the points (34) and (39), the points (35) and (40), the points (36) and (41), the points (37) and (48) is the rest for folding.

Figure 13:
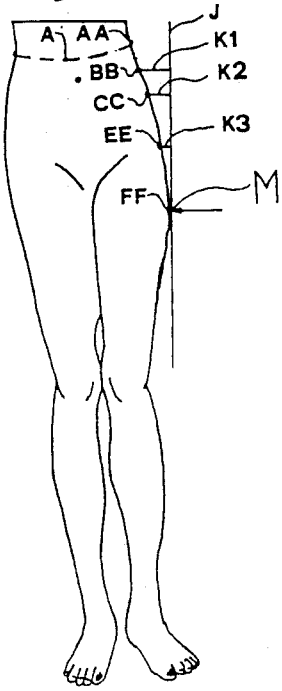

Please refer to FIG. 16 and FIG. 13 wherein the side point (FF) at the hip line is the protruding point (as the M size in FIG. 13). Only the difference between FIGS. 15 and 16 will be discussed here.

Set a point (M1) leftward along the horizontal line from the point (13) at a distance equal to ½ of the size (k3) (½ of 1 cm=0.5 cm) then draw a vertical line (M0) through the point (M1) downward to the horizontal line (44) and upward to respectively cross with the horizontal lines (4), (23), (19) and (21) at the cross points (M2), (M3), (M4) and (M5); set a point (M6) rightward along the horizontal line (4) from the point (M2) at a distance equal to ½ of the size (K3) (½ of 1 cm=0.5 cm) and set a point (M8) rightward along the horizontal line (19) from the point (M4) at a distance equal to ½ of the size (K2) (½ of 4 cm=2 cm) and then set a point (M9) rightward along the horizontal line (21) from the point (M5) at a distance equal to ½ of the size (K1) (½ of 6 cm=3 cm); draw a curved line to connect the points (M1), (M6), (M8) and (M9) and to cross with the horizontal line (1) at a cross point (M10) so as to complete the side line of the basic layout drawing for M size. Only the difference between FIGS. 15 and 17 will be discussed here.

Figure 14:
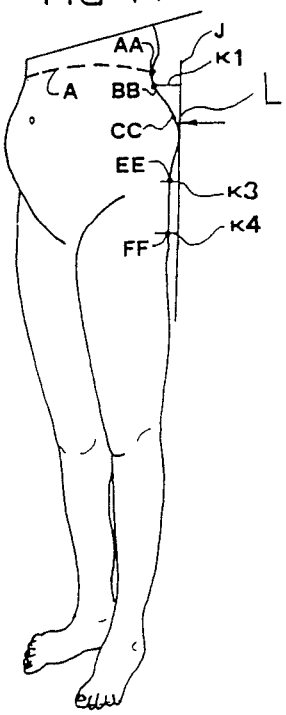

Please refer to FIG. 17 and FIG. 14 wherein the side point (CC) is the protruding point (as the L size in FIG. 14). Set a point (L1) leftward along the horizontal line (19) from the point (17) at a distance equal to ½ of the size (K3) (½ of 2 cm=1 cm), then draw a vertical line (L0) through the point (L1) downward to the horizontal line (44) and upward to the horizontal line (1) to cross with the horizontal line (21) at a cross point (L2); set a point (L3) rightward along the horizontal line (21) from the point (L2) at a distance equal to ½ of the size (K1) (½ of 1 cm=0.5 cm); draw a curved line (L4) upward from the point (L1) to cross with the horizontal line (1) at a cross point (L15) so as to complete a basic layout drawing for L size.

I claim:

1. In a method of preparing a pattern drawing of a custom-tailored skirt from at least some of the data obtained from a measure around a person's waistline, a measure of a first lower waistline around the person's abdomen 5 cm below said waistline, a measure of a second lower waistline around the person's abdomen 10 cm below said waistline, a measure around the largest part of the person's hip, a measure around the bottom part of the person's hip, and a measure of the desired length of the skirt, the steps comprising:

drawing from a preselected point (1) a horizontal line in a leftward direction, and a vertical line in a downward direction, setting a point (2) 5 cm downward from said point (1) along said vertical line, drawing a horizontal line leftward from said point (2) at a length equal to at least ¼ of said measure of said first lower waistline so as to obtain a point (3), and so as to take any desired slack into consideration, setting a point (4) downwardly from the vertical line originating from the point (1) so as to correspond to the depth from said waistline to said largest part of the hip, which depth should be about 10 cm, drawing a horizontal line leftward from the point (4) so as to correspond in length to at least ¼ of said measure around said second lower waistline, so as to obtain a point (5), and so as to take any desired slack into consideration, setting a point (6) downwardly along said vertical line originating from said point (1) so as to correspond to the depth from said waistline to the largest part of the hip, which should be about 22 cm, drawing a line leftward from the point (6) at a length equal to at least ¼ of the measure around the largest part of the hip so as to obtain a point (7), and so as to take any desired slack into consideration, setting a point (8) downwardly from the vertical line originating from the point (1) so as to correspond to the depth from said waistline to said bottom of the hip, which should be about 28 cm, drawing a horizontal line leftward from the point (8) at a length equal to at least ¼ of the measure around the bottom of the hip, so as to obtain a point (9), and so as to take any desired slack into consideration, setting a point (10) downwardly along said vertical line originating from the point (1) at a distance equal to the selected length of the skirt, and drawing therefrom leftwardly a horizontal expansion line for expansion of the skirt, setting a point (11) at the same position as the point (7), drawing a vertical line downwardly from the point (7), denote a point obtained from an intersection of the last-named downwardly directed vertical line with said horizontal line for expansion of the skirt as point (12), drawing a curved line (13) upwardly from the point (11) to cross with the horizontal line extending from the point (1), setting a point (14) at 1/6 of the spacing between the points [(8) and (9)] (6) and (7) above an intersection of the curved line (13) with the horizontal line extending leftwardly from the point (1), setting a point (16) 1.3 cm downwardly along the vertical line originating at the point (1) at a distance equal to ¼ of the measure around said waistline, setting a point (17) leftwardly along the horizontal line emanating from the point (1) at a distance equal to ¼ of the measure around the waistline (A') to yield a size for the waistline (A');

whereby, upon connecting a periphery of the points (1) through (17) with lines, a basic layout pattern is obtained.

2. In a method of preparing a pattern drawing of a custom-tailored skirt according to claim 1, further comprising the steps drawing a curve from the point (5) through one of the points (7) and (9) to a bottom point (18) lying on the expansion line of the skirt to form an inclined line (18'), and drawing a cutting line with the aid of a triangle with the longest side of the latter coinciding with the inclined line (18'), which latter line extends from the point (11) to the point (18), and with the shortest side of said triangle passing through one third of the width of the expansion as defined by the line joining points (10) and (18), whereby the basic layout pattern is completed.

3. In a method of preparing a pattern drawing of a custom-tailored skirt for a person's body from at least some of the data obtained from a measure around the waistline (A), a measure (C) around the largest part of the abdomen below the waistline, a depth of the waistline (C1) as measured laterally from the waistline (A) to the measure (C), a measure around the abdomen (B) lying between the measures (A) and (C), a lateral depth from the waistline (A) to the measure around the abdomen being defined as the depth (B1), a measure around the largest part of the hip (E), a line around the hip being defined as the hipline (E), a region below said hipline but considerably above the knee being defined as (E1), a depth of the hipline (E2) being defined as the lateral measure from the waistline (A) to said hipline (E), a measure around an upper portion of the hip between the measure (C) and the hipline (E) being defined as an upper hipline (D), a measure from said waistline (A) to the upper hipline (D) being defined as (D1), a measure around a lowermost part of the hip near the bottom of the crotch being defined as (F), a depth from the waistline (A) to a lowermost hipline (F) being defined as (F1), a measure from a side of the waistline (A) to the ground being defined as a side length (H), a measure from the front of the waistline to the ground being defined as a length (G), a measure from the back of the waistline through any horizontally protruding part of the hip to the ground being defined as (I), there being further defined on the person's body a lateral point (AA) for the waistline (A), a lateral point (BB) for the top abdomen (B), a lateral point (CC) for the bottom abdomen (C), a lateral point (EE) for the lower hip (E), a lateral point (FF) for the lowermost hip (F), and with the aid of a vertically extending straight line (J) covering at least the area between the waistline (A) and the lowermost hipline (F) there being further defined a horizontal width (K1) to said vertically extending line (J) from the lateral point (BB), a horizontal width (K2) to said vertically extending line (J) from the lateral point (CC), a horizontal width (K3) to said vertically extending line (J) from the lateral point (EE), and a horizontal width (K4) to said vertically extending line (J) from the lateral point (FF), the steps comprising using a starting point, drawing a horizontally extending line (1) leftwardly from said starting point at a length exceeding ¼ of the measure (E), drawing a vertical line (2) downwardly from the left end of the horizontal line (1), setting a point (3) along the vertical line (2) from the point (1) at a distance equal to the depth (E2), drawing a horizontal and rightwardly extending line (4) from the point (3), and then setting a point (5) rightwardly along the horizontal line (4) from the point (3) at a distance equal to ¼ of the measure (E), drawing a vertical line through the point (5) as a central line through a back piece (R) so as to intersect upwardly with the horizontal line (1) at an intersection point (7), and so as to intersect downwardly with an expansion line (44) of the skirt at a point (46'), setting a point (8) rightwardly along a horizontal line from the point (5) at a distance equal to ½ of the difference between the measure (E) and the measure (E1), drawing from the point (8) a vertical line (9) as a central line upwardly for a front piece of the skirt (T) to intersect at a point (10) with the horizontal line (1), and downwardly to the expansion line (44) of the skirt, comparing the measured front length (G) and the lateral length (H) and if the length (G) is shorter than the length (H), using the difference by setting a point (11) downwardly from the point (10) along the vertical line (9), and drawing therefrom a horizontal line (42) to intersect with the vertical line (6) at an intersection point (47), if the length (G) is greater than the length (H) using the difference by setting a point (11) upwardly from the point (10) along the vertical line (9) as the top point of the central line (9) of the front piece of the skirt (T), comparing the measured back length (I) and the lateral length (H), if the length (I) is shorter than the length (H) using the difference by setting a point (12) downwardly along the vertical line (6) from the point (7) as the top point of the central line of the back piece of the skirt (R), setting a point (13) downwardly along the vertical line (2) from a leftmost point (45) at a distance equal to (F1), drawing from the point (13) a horizontal line (14) rightwardly to intersect with the central line (6) of the back piece of the skirt (R) at an intersection point (15) at a distance equal to ¼ of the measure (F), setting a point (17) downwardly from the point (45) along the vertical line (2) at a distance equal to the depth (C1), thereafter setting a point (18) downwardly along the vertical line (9) from the point (11) at a distance also equal to the depth (C1), thereafter drawing a line (46) inclined with the horizontal so as to connect the points (17) and (18), and so as to intersect with the vertical line (6) at a cross-point (49), thereafter drawing another line (50) so as to connect the points (5) and (18), setting a point (19) downwardly along the vertical line (2) from the point (45) at a distance equal to the depth (B1), setting a point (20) downwardly along the vertical line (9) from the point (11) at a distance equal to the depth (B1);

drawing a line (21) inclined at an angle with the horizontal so as to connect the points (19) and (20), and so as to intersect with the vertical line (6) at an intersection point (48), setting a point (22) downwardly along the vertical line (2) from the point (45) at a distance equal to the depth (D1), thereafter drawing a horizontal line (23) rightwardly from the point (22) to intersect with the vertical line (6) at an intersection point (24), and to intersect with the inclined line (50) at an intersection point (25), setting a point (26) downwardly along the vertical line (6) from the point (12) at a distance equal to the depth (B1), thereafter drawing an inclined line (27) so as to connect the points (19) and (26), setting a point (28) downwardly along the vertical line (6) from the point (12) at a distance equal to the depth (C1), thereafter drawing an inclined line (29) so as to connect the points (17) and (28), setting a central point (30) between the points (11) and (47) of the central lines (9) and (6), respectively, setting a central point (31) between the points (20) and (48), setting a central point (32) between the points (18) and (49), setting a central point (33) between the points (25) and (24), setting a point (34) leftwardly from the point (30) along the horizontal line (1) at a distance equal to ¼ of the measure (A), setting a point (35) leftwardly along the horizontal line (21) from the point (31) at a distance equal to ¼ of the measure (B), setting a point (36) leftwardly along the horizontal line (46) from the point (32) at a distance equal to ¼ of the measure (C), setting a point (37) leftwardly along the horizontal line (23) from the point (33) at a distance equal to ¼ of the measure (D), setting a point (41) rightwardly along the horizontal line (46) from the point (17) at a distance equal to ½ the measure (K2), thereafter setting a point (40) rightwardly along the horizontal line (21) from the point (19) at a distance equal to ½ the measure (K1), thereafter drawing a curved line (38) upwardly from the point (13) through points (41) and (40) to intersect with the horizontal line (1) at an intersection point (39), drawing a straight horizontal line leftwardly from the point (11) to a distance of one third of the length between points (11) and (39), and drawing a continuation of the last-named line in a curved shape up to said point (39) so as to form a complete waistline (42) for the front piece;

drawing another waistline (43) for the back piece in a similar manner as that for the waistline (42) from the point (12) to the point (39), setting the horizontal line (44) for the expansion of the skirt downward from the horizontal line (1) at a distance selected for the length of the skirt, and so as to intersect with the vertical lines (2), (6), and (9) at the intersection points (47), (46') and (45'), respectively, drawing the outline for the front piece from the starting point (11) downwardly along the vertical line (9) to the intersection point (45'), then turning leftward along the horizontal line (44) to the point (47), and then turning upward along the vertical line (2) to the point (3), and proceeding therefrom along the curved line (38) through points (41) and (40) up to the point (39), and then proceeding rightwardly along the line (42) to the starting point (11), drawing the outline for the back piece from the starting point (12) along the vertical line (6) to the point (46), thereafter turning leftward along the horizontal line (44) to the point (47), thereafter turning upward to the point (3), and then along the curved line (38) through points (48), (41) and (40) to the point (39), and thereafter returning rightward along the waistline (43) to the starting point (12).

4. In a method of preparing a pattern drawing of a custom-tailored skirt for a person's L-shaped body configuration from at least some of the data obtained from a measure around the waistline (A), a measure (C) around the largest part of the abdomen below the waistline, a depth of the waistline (C1) as measured laterally from the waistline (A) to the measure (C), a measure around the abdomen (B) lying between the measures (A) and (C), a lateral depth from the waistline (A) to the measure around the abdomen being defined as the depth (B1), a measure around the largest part of the hip (E), a line around the hip being defined as the hipline (E), a region below said hipline but considerably above the knee being defined as (E1), a depth of the hipline (E2) being defined as the lateral measure from the waistline (A) to said hipline (E), a measure around an upper portion of the hip between the measure (C) and the hipline (E) being defined as an upper hipline (D), a measure from said waistline (A) to the upper hipline (D) being defined as (D1), a measure around a lowermost part of the hip near the bottom of the crotch being defined as (F), a depth from the waistline (A) to a lowermost hipline (F) being defined as (F1), a measure from a side of the waistline (A) to the ground being defined as a side length (H), a measure from the front of the waistline to the ground being defined as a length (G), a measure from the back of the waistline through any horizontally protruding part of the hip to the ground being defined as (I), there being further defined on the person's body a lateral point (AA) for the waistline (A), a lateral point (BB) for the top abdomen (B), a lateral point (CC) for the bottom abdomen (C), a lateral point (EE) for the lower hip (E), a lateral point (FF) for the lowermost hip (F), and with the aid of a vertically extending straight line (J) covering at least the area between the waistline (A) and the lowermost hipline (F) there being further defined a horizontal width (K1) to said vertically extending line (J) from the lateral point (BB), a horizontal width (K2) to said vertically extending line (J) from the lateral point (CC), a horizontal width (K3) to said vertically extending line (J) from the lateral point (EE), and a horizontal width (K4) to said vertically extending line (J) from the lateral point (FF), and wherein the point (FF) is a laterally furthermost protruding point on one side of the person's body, the steps comprising using a starting point, drawing a horizontally extending line (1) leftwardly from said starting point at a length exceeding ¼ of the measure (E), drawing a vertical line (2) downwardly from the left end of the horizontal line (1), setting a point (3) along the vertical line (2) from the point (1) at a distance equal to the depth (E2), drawing a horizontal and rightwardly extending line (4) from the point (3), and then setting a point (5) rightwardly along the horizontal line (4) from the point (3) at a distance equal to ¼ of the measure (E), drawing a vertical line through the point (5) as a central line through a back piece (R) so as to intersect upwardly with the horizontal line (1) at an intersection point (7), and so as to intersect downwardly with an expansion line (44) of the skirt at a point (46'), setting a point (8) rightwardly along a horizontal line from the point (5) at a distance equal to ½ of the difference between the measure (E) and the measure (E1), drawing from the point (8) a vertical line (9) as a central line upwardly for a front piece of the skirt (T) to intersect at a point (10) with the horizontal line (1), and downwardly to the expansion line (44) of the skirt, comparing the measured front length (G) and the lateral length (H) and if the length (G) is shorter than the length (H), using the difference by setting a point (11) downwardly from the point (10) along the vertical line (9), and drawing therefrom a horizontal line (42) to intersect with the vertical line (6) at an intersection point (47), if the length (G) is greater than the length (H) using the difference by setting a point (11) upwardly from the point (10) along the vertical line (9) as the top point of the central line (9) of the front piece of the skirt (T), comparing the measured back length (I) and the lateral length (H), if the length (I) is shorter than the length (H), using the difference by setting a point (12) downwardly along the vertical line (6) from the point (7) as the top point of the central line of the back piece of the skirt (R), setting a point (13) downwardly along the vertical line (2) from a leftmost point (45) at a distance equal to (F1), drawing from the point (13) a horizontal line (14) rightwardly to intersect with the central line (6) of the back piece of the skirt (R) at an intersection point (15) at a distance equal to ¼ of the measure (F), setting a point (M1) leftward along the horizontal line originating from the point (13) at a distance equal to ½ of the width (K3);

setting a point (17) downwardly from the point (45) along the vertical line (2) at a distance equal to the depth (C1), thereafter setting a point (18) downwardly along the vertical line (9) from the point (11) at a distance also equal to the depth (C1), thereafter drawing a line (46) inclined with the horizontal so as to connect the points (17) and (18), and so as to intersect with the vertical line (6) at a crosspoint (49), thereafter drawing another line (50) so as to connect the points (5) and (18), setting a point (19) downwardly along the vertical line (2) from the point (45) at a distance equal to the depth (B1), setting a point (20) downwardly along the vertical line (9) from the point (11) at a distance equal to the depth (B1);

drawing a line (21) inclined at an angle with the horizontal so as to connect the points (19) and (20), and so as to intersect with the vertical line (6) at an intersection point (48), drawing a vertically extending line (M0) through the point (M1) downwardly to the horizontal line (44), and upwardly to intersect with the horizontal lines (4), (23), (19) and (21) at intersection points (M2), (M3), (M4) and (M5), respectively, setting a point (M6) rightwardly along the horizontal line (4) from the point (M2) at a distance equal to ½ of the width (K3), setting a point (M7) downwardly along the vertical line (2) from the point (45) at a distance equal to the depth (D1), thereafter drawing a horizontal line (23) rightwardly from the point (M7) to intersect with the vertical line (6) at an intersection point (24), and to intersect with the inclined line (50) at an intersection point (25), setting a point (26) downwardly along the vertical line (6) from the point (12) at a distance equal to the depth (B1), thereafter drawing an inclined line (27) so as to connect the points (19) and (26), setting a point (28) downwardly along the vertical line (6) from the point (12) at a distance equal to the depth (C1), thereafter drawing an inclined line (29) so as to connect the points (17) and (28), setting a central point (30) between the points (11) and (47) of the central lines (9) and (6), respectively, setting a central point (31) between the points (20) and (48), setting a central point (32) between the points (18) and (49), setting a central point (33) between the points (25) and (24), setting a point (34) leftwardly from the point (30) along the horizontal line (1) at a distance equal to ¼ of the measure (A), setting a point (35) leftwardly along the horizontal line (21) from the point (31) at a distance equal to ¼ of the measure (B), setting a point (36) leftwardly along the horizontal line (46) from the point (32) at a distance equal to ¼ of the measure (C), setting a point (37) leftwardly along the horizontal line (23) from the point (33) at a distance equal to ¼ of the measure (D), setting a point (41) rightwardly along the horizontal line (46) from the point (17) at a distance equal to ½ the measure (K2), setting a point (M8) rightwardly along the horizontal line line (4) from the point (M4) at a distance equal to ½ of the width (K2), and thereafter setting a point (M9) rightwardly along the horizontal line (21) from the point (M5) at a distance equal to ½ the width (K1), and thereafter drawing a curved line (38) upwardly from the point (13) through points (M8) and (M9) to intersect with the horizontal line (1) at an intersection point (M10), drawing a straight horizontal line leftwardly from the point (11) to a distance of one third of the length between points (11) and (M10), and drawing a continuation of the last-named line in a curved shape up to said point (M10) so as to form a complete waistline (42) for the front piece, drawing another waistline (43) for the back piece in a similar manner as that for the waistline (42) from the point (12) to the point (M10), setting the horizontal line (44) for the expansion of the skirt downward from the horizontal line (1) at a distance selected for the length of the skirt, and so as to intersect with the vertical lines (2), (6), and (9) at the intersection points (47), (46'), and (45'), respectively, drawing the outline for the front piece from the starting point (11) downwardly along the vertical line (9) to the intersection point (45'), then turning leftward along the horizontal line (44) to the point (47), and then turning upward so as to connect the points (M1), (M6), (M8) and (M9) along a curved line (38), and extending the line (38) so as to intersect with the horizontal line (1) at an intersection point (M10), and then proceeding rightwardly along the line (42) to the starting point denoted as point (11) so as to complete the lateral contour of the basic layout drawing for an M-sized body configuration.

5. In a method of preparing a pattern drawing of a custom-tailored skirt for a person's L-shaped body configuration from at least some of the data obtained from a measure around the waistline (A), a measure (C) around the largest part of the abdomen below the waistline, a depth of the waistline (C1) as measured laterally from the waistline (A) to the measure (C), a measure around the abdomen (B) lying between the measures (A) and (C), a lateral depth from the waistline (A) to the measure around the abdomen being defined as the depth (B1), a measure around the largest part of the hip (E), a line around the hip being defined as the hipline (E), a region below said hipline but considerably above the knee being defined as (E1), a depth of the hipline (E2) being defined as the lateral measure from the waistline (A) to said hipline (E), a measure around an upper portion of the hip between the measure (C) and the hipline (E) being defined as an upper hipline (D), a measure from said waistline (A) to the upper hipline (D) being defined as (D1), a measure around a lowermost part of the hip near the bottom of the crotch being defined as (F), a depth from the waistline (A) to a lowermost hipline (F) being defined as (F1), a measure from a side of the waistline (A) to the ground being defined as a side length (H), a measure from the front of the waistline to the ground being defined as a length (G), a measure from the back of the waistline through any horizontally protruding part of the hip to the ground being defined as (I), there being further defined on the person's body a lateral point (AA) for the waistline (A), a lateral point (BB) for the top abdomen (B), a lateral point (CC) for the bottom abdomen (C), a lateral point (EE) for the lower hip (E), a lateral point (FF) for the lowermost hip (F), and with the aid of a vertically extending straight line (J) covering at least the area between the waistline (A) and the lowermost hipline (F) there being further defined a horizontal width (K1) to said vertically extending line (J) from the lateral point (BB), a horizontal width (K2) to said vertically extending line (J) from the lateral point (CC), a horizontal width (K3) to said vertically extending line (J) from the lateral point (EE), and a horizontal width (K4) to said vertically extending line (J) from the lateral point (FF), and wherein the point (CC) is a laterally furthermost protruding point on one side of the person's body, the steps comprising using a starting point, drawing a horizontally extending line (1) leftwardly from said starting point at a length exceeding ¼ of the measure (E), drawing a vertical line (2) downwardly from the left end of the horizontal line (1), setting a point (3) along the vertical line (2) from the point (1) at a distance equal to the depth (E2), drawing a horizontal and rightwardly extending line (4) from the point (3), and then setting a point (5) rightwardly along the horizontal line (4) from the point (3) at a distance equal to ¼ of the measure (E), drawing a vertical line through the point (5) as a central line through a back piece (R) so as to intersect upwardly with the horizontal line (1) at an intersection point (7), and so as to intersect downwardly with the expansion line (44) of the skirt at a point (46'), setting a point (8) rightwardly along a horizontal line from the point (5) at a distance equal to ½ of the difference between the measure (E) and the measure (E1), drawing from the point (8) a vertical line (9) as a central line upwardly for a front piece of the skirt (T) to intersect at a point (10), being said starting point, with the horizontal line (1), and downwardly to an expansion line (44) of the skirt, comparing the measured front length (G) and the lateral length (H) and if the length (G) is shorter than the length (H), using the difference by setting a point (11) downwardly from the point (10) along the vertical line (9), and drawing therefrom a horizontal line (42) to intersect with the vertical line (6) at an intersection point (47), if the length (G) is greater than the length (H) using the difference in size by setting a point (11) upwardly from the point (10) along the vertical line (9) as the top point of the central line (9) of the front piece of the skirt (T), comparing the measured back length (I) and the lateral length (H), if the length (I) is shorter than the length (H) using the difference in size by setting a point (12) downwardly along the vertical line (6) from the point (7) as the top point of the central line of the back piece of the skirt (R), setting a point (13) downwardly along the vertical line (2) from a leftmost point (L5) at a distance equal to (F1), drawing from the point (13) a horizontal line (14) rightwardly to intersect with the central line (6) of the back piece of the skirt (R) at an intersection point (15) at a distance equal to ½ of the measure (F), setting a point (17) downwardly from the point (L5) along the vertical line (2) at a distance equal to the depth (C1), setting a point (L1) leftwardly along the horizontal line (19) from the point (17) at a distance equal to ½ of the width (K3), thereafter drawing a vertical line (L0) through the point (L1) downwardly to the horizontal line (44), and upwardly to the horizontal line (1) to intersect therewith at an intersection point (L6), thereafter setting a point (18) downwardly along the vertical line (9) from the point (11) at a distance also equal to the depth (C1), thereafter drawing a line (46) inclined with the horizontal so as to connect the points (17) and (18), and so as to intersect with the vertical line (6) at a crosspoint (49), thereafter drawing another line (50) so as to connect the points (5) and (18), setting a point (L2) downwardly along the vertical line (2) from the point (L5) at a distance equal to the depth (B1), setting a point (20) downwardly along the vertical line (9) from the point (11) at a distance equal to the depth (B1);

drawing a line (21) inclined at an angle with the horizontal so as to connect the points (L2) and (20), and so as to intersect with the vertical line (6) at an intersection point (48), setting a point (L3) rightwardly along the horizontal line (21) from the point (L2) at a distance equal to ½ the width (K1), setting a point (22) downwardly along the vertical line (2) from the point (L5) at a distance equal to the depth (D1), thereafter drawing a horizontal line (23) rightwardly from the point (22) to intersect with the vertical line (6) at an intersection point (24), and to intersect with the inclined line (50) at an intersection point (25), setting a point (26) downwardly along the vertical line (6) from the point (12) at a distance equal to the depth (B1), thereafter drawing an inclined line (27) so as to connect the points (19) and (L2), setting a point (28) downwardly along the vertical line (6) from the point (12) at a distance equal to the depth (C1), thereafter drawing an inclined line (29) so as to connect the points (17) and (28), setting a central point (30) between the points (11) and (7) of the central lines (9) and (6), respectively, setting a central point (31) between the points (20) and (48), setting a central point (32) between the points (18) and (49), setting a central point (33) between the points (25) and (24), setting a point (34) leftwardly from the point (30) along the line (42) at a distance equal to ¼ of the measure (A), setting a point (35) leftwardly along the horizontal line (21) from the point (31) at a distance equal to ¼ of the measure (B), drawing a slightly convexly curved line (42) leftwardly from the point (11) so as to connect points (11) and (L5);

drawing a straight horizontal line (1) leftwardly from the point (10) to the point (L5), drawing another waistline (43) for the back piece in a similar manner as that for the waistline (42) from the point (12) to the point (L5), setting a horizontal line (44) for the expansion of the skirt downward from the horizontal line (1) at a distance selected for the length of the skirt, and so as to intersect with the vertical lines (2), (6), and (9) at the intersection points (47), (46') and (45'), respectively, and drawing a curved line (L4) upwardly from the point (L1) to intersect with the horizontal line (1) at an intersection point (L5) spaced from an upward extension of the vertical line (L10) rightwardly by a distance equal to the spacing between the points (L1) and (17), so as to complete the basic layout pattern for an L-sized body configuration.

* * * * *